US005097654A

United States Patent [19]

Latsounas et al.

[11] Patent Number: 5,097,654

[45] Date of Patent: Mar. 24, 1992

[54] ENVELOPE FILLER AND SEALER

[76] Inventors: Antonio Latsounas, 7720 25th Ave., Jackson Heights, N.Y. 11370; George Spector, 233 Broadway RM 3815, New York, N.Y. 10007

[21] Appl. No.: 656,457

[22] Filed: Feb. 19, 1991

[51] Int. Cl.[5] ..... B65B 43/36; B65B 67/00

[52] U.S. Cl. ..... 53/569; 53/284.3; 53/385.1; 53/390

[58] Field of Search ..... 53/569, 284.3, 284.7, 53/381.5, 385.1, 390, 383.1, 377.4

[56] References Cited

U.S. PATENT DOCUMENTS

| | | | |
|---|---|---|---|
| 1,538,712 | 5/1925 | McCormick | 53/390 |
| 1,600,320 | 9/1926 | Danquigney | 53/385.1 X |
| 2,019,211 | 10/1935 | Clare | 53/385.1 X |
| 2,020,415 | 11/1935 | Hirsch | 53/385.1 |
| 2,788,627 | 4/1957 | Bellows | 53/284.3 X |
| 3,138,907 | 6/1964 | Gerbe | 53/385.1 |
| 3,367,087 | 2/1968 | Jarund | 53/385.1 X |

*Primary Examiner*—James F. Coan

[57] ABSTRACT

An apparatus for filling and sealing an envelope is provided and consists of a housing having an angled front panel and an exhaust port. A mechanism is on the housing for retaining an open flap of the envelope to the angled front panel below the exhaust port. A blower within the housing is for blowing air through the exhaust port and into the envelope so that it can be filled. Another mechanism is on the housing for wetting glue on the flap of the envelope so that the evenlope can be sealed.

4 Claims, 1 Drawing Sheet

ENVELOPE FILLER AND SEALER

BACKGROUND OF THE INVENTION

The instant invention relates generally to stationary accessories and more specifically it relates to an apparatus for filling and sealing an envelope which provides a mechanism for blowing the envelope open and for wetting the flap glue so that the envelope can be sealed.

There are available various conventional stationary accessories which do not provide the novel improvements of the invention herein disclosed.

SUMMARY OF THE INVENTION

A primary object of the present invention is to provide an apparatus for filling and sealing an envelope that will overcome the shortcomings of the prior art devices.

Another object is to provide an apparatus for filling and sealing an envelope that contains a built-in blower which opens the envelope held thereon by its flap so that the envelope can be filled.

An additional object is to provide an apparatus for filling sealing an envelope that contains a mechanism for wetting the glue on the envelope flap so that the envelope can be sealed.

A further object is to provide an apparatus for filling and sealing an envelope that is simple and easy to use.

A still further object is to provide an apparatus for filling and sealing an envelope that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
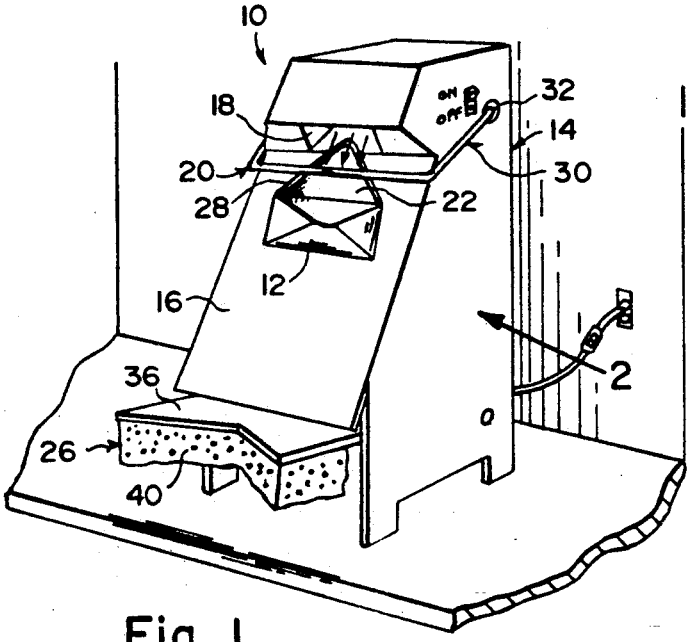
FIG. 1 is a perspective view of the instant invention showing the envelope air blown open for filling and a lower sponge to wet the flap glue for sealing.

Turning now descriptively to the drawings, in which similar reference characters denote similar elements throughout the several views, the Figures illustrate an apparatus 10 for filling and sealing an envelope 12 which consists of a housing 14 having an angled front panel 16 and an exhaust port 18. A mechanism 20 is on the housing 14 for retaining an open flap 22 of the envelope 12 to the angled front panel 16 of the housing 14 below the exhaust port 18 on the housing 14. A blower 24 is within the housing 14 for blowing air through the exhaust port 18 in said housing 14 and into the envelope 12 so that the envelope 12 can be filled. Another mechanism 26 is on the housing 14 for wetting glue 28 on the flap 22 of the envelope 12 so that the envelope 12 can be sealed.

The retaining mechanism 20 includes a U-shaped holder 30 pivotally mounted at 32 to the housing 14. A spring 34 is within the housing 14 for biasing the holder 30 downwardly to retain the flap 22 of the envelope 12 to the angled front panel 16.

The glue wetting mechanism 26 includes an arm 36 extending from the housing 24 below the angled front panel 16. A second spring 38 is within the housing 14 for biasing the arm 36 downwardly. A sponge 40 is mounted to the distal end of the arm 36 to wet the glue 28 on the flap 22 of the envelope 12.

Figure 3:
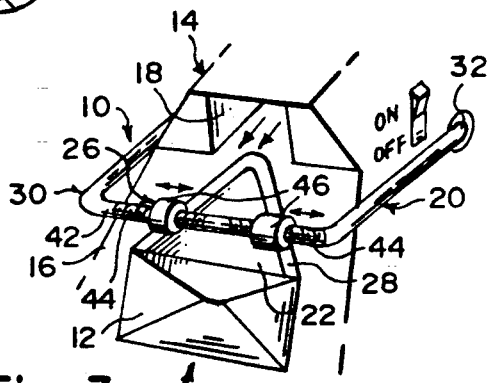
FIG. 3 is a perspective view of a portion of a first modification showing the envelope flap holder having a flap glue wetting mechanism responsive to removal of the envelope from the filling position.
Figure 2:
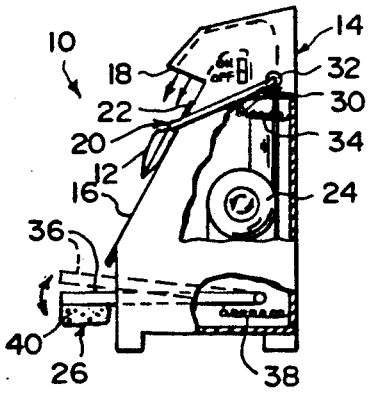
FIG. 2 is a side view as indicated by arrow 2 in FIG. 1 with parts broken away for viewing the internal structure.

As shown in FIG. 3, the glue wetting mechanism 26 includes the U-shaped holder 30 having a cross segment 42 with two sets of opposite angled threads 44. A pair of water retaining rollers 46 are engagable with the threads 44 which when responsive to the removal of the flap 22 from the holder 30 the rollers 46 will ride along and wet the glue 28 on the flap 22 of the envelope 12.

Figure 4:
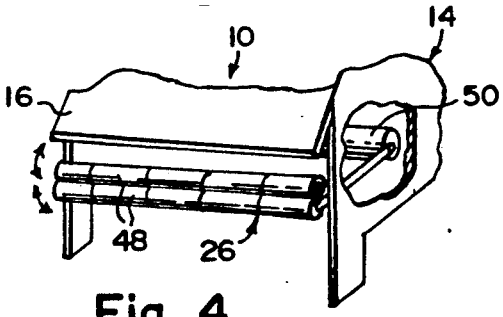
FIG. 4 is a perspective view of a portion of a second modification showing a flap glue wetting and sealing mechanism.

As shown in FIG. 4 the glue wetting mechanism 26 includes a pair of engagable elongated water retaining rollers 48 pivotally mounted on the housing 14 below the angled front panel 16. A motor 50 is within the housing 14 for rotating the rollers 48 to wet the glue 28 on the flap 22 of the envelope 12.

Figure 5:
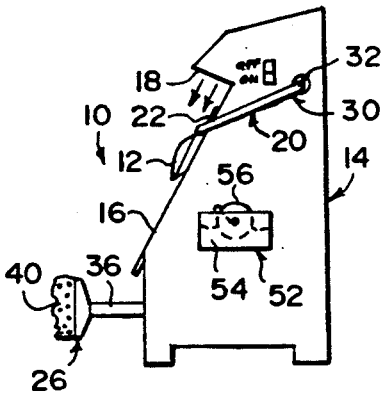
FIG. 5 is a side view of a third modification showing another type of lower sponge and a stamp wetting mechanism.

The apparatus 10 as shown in FIG. 5, further includes a stamp wetting mechanism 52 having a water retaining reservoir 54 and a rotatable drum 56 carried in the reservoir 54 with the top of the drum 56 extending above the top of the reservoir 54. When the drum 56 is rotated it will pick up water from the reservoir 54 and place the water upon a stamp which then can be put on the envelope 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An apparatus for filling and sealing an envelope which comprises:

(a) a housing having an angled front panel and an exhaust port;

(b) means on said housing for retaining an open flap of the envelope to the angled front panel of said housing below the exhaust port in said housing;

(c) a blower within said housing for blowing air through the exhaust port in said housing and into the envelope so that the envelope can be filled;

(d) means on said housing for wetting glue on the flap of the envelope so that the envelope can be sealed; wherein said retaining means includes:

(e) a U-shaped holder pivotally mounted to said housing;

(f) a spring within said housing for biasing said holder downwardly to retain the flap of the envelope to the angled front panel; wherein said glue wetting means includes:

(g) an arm extending from said housing;

(h) a second spring within said housing for biasing said arm downwardly; and (i) a sponge mounted to the distal end of said arm to wet the glue on the flap of the envelope.

2. An apparatus for filling and sealing an envelope which comprises:

(a) a housing having an angled front panel and an exhaust port;

(b) means on said housing for retaining an open flap of the envelope to the angled front panel of said housing below the exhaust port in said housing;

(c) a blower within said housing for blowing air through the exhaust port in said housing and into the envelope so that the envelope can be filled;

(d) means on said housing for wetting glue on the flap of the envelope so that the envelope can be sealed; wherein said retaining means includes:

(e) a U-shaped holder pivotally mounted to said housing;

(f) a spring within said housing for biasing said holder downwardly to retain the flap of the envelope to the angled front panel; wherein said glue wetting means includes:

(g) said U-shaped holder having a cross segment with two sets of opposite angled threads; and (h) a pair of water retaining rollers engagable with said threads which when responsive to the removal of the flap from said holder said rollers will ride along and wet the glue on the flap of the envelope.

3. An apparatus for filling and sealing an envelope which comprises:

(a) a housing having an angled front panel and an exhaust port;

(b) means on said housing for retaining an open flap of the envelope to the angled front panel of said housing below the exhaust port in said housing;

(c) a blower within said housing for blowing air through the exhaust port in said housing and into the envelope so that the envelope can be filled;

(d) means on said housing for wetting glue on the flap of the envelope so that the envelope can be sealed; wherein said retaining means includes:

(e) a U-shaped holder pivotally mounted to said housing;

(f) a spring within said housing for biasing said holder downwardly to retain the flap of the envelope to the angled front panel; wherein said glue wetting means includes:

(g) a pair of engagable elongated water retaining rollers pivotally mounted on said housing below the angled front panel; and a motor within said housing for rotating said rollers to wet the glue on the flap of the envelope.

4. An apparatus for filling and sealing an envelope which comprises:

(a) a housing having an angled front panel and an exhaust port;

(b) means on said housing for retaining an open flap of the envelope to the angled front panel of said housing below the exhaust port in said housing;

(c) a blower within said housing for blowing air through the exhaust port in said housing and into the envelope so that the envelope can be filled;

(d) means on said housing for wetting glue on the flap of the envelope so that the envelope can be sealed; wherein said retaining means includes:

(e) a U-shaped holder pivotally mounted to said housing;

(f) a spring within said housing for biasing said holder downwardly to retain the flap of the envelope to the angled front panel; further including a stamp wetting mechanism having a water reatining reservoir and a rotatable drum carried in said reservoir with the top of said drum extending above the top of said reservoir so that when said drum is rotated it will pick up water from said reservoir and place the water upon a stamp which then can be put on the envelope.

* * * * *